United States Patent [19]

Grieco

[11] 4,245,568

[45] Jan. 20, 1981

[54] ROOF BAFFLES FOR FLUEWORK TRANSPORTING DUST-LADEN GASES

[75] Inventor: Gary J. Grieco, Somerville, N.J.

[73] Assignee: Research Cottrell, Inc., Somerville, N.J.

[21] Appl. No.: 29,934

[22] Filed: Apr. 13, 1979

[51] Int. Cl.[3] ..... F23J 11/00

[52] U.S. Cl. ..... 110/147; 110/203; 126/297

[58] Field of Search ..... 110/203, 211, 216, 344, 110/345, 322, 323, 326, 147, 148, 145; 126/296, 297

[56] References Cited

U.S. PATENT DOCUMENTS

| | | | |
|---|---|---|---|
| 503,930 | 11/1897 | Fraser | 126/296 |
| 1,722,801 | 7/1929 | Kelm | 126/296 |
| 2,097,544 | 11/1937 | Ames | 126/296 |
| 2,684,647 | 7/1954 | Bither | 110/163 |
| 3,656,440 | 4/1972 | Grey | 110/216 X |

*Primary Examiner*—Edward G. Favors

[57] ABSTRACT

Moveable and fixed vertically depending, longitudinally spaced baffles are mounted perpendicular to the direction of gas flow on the roof of large generally horizontal runs of flues carrying dust laden gas as a cost-effective way to reduce gravitational dust dropout.

4 Claims, 4 Drawing Figures

ROOF BAFFLES FOR FLUEWORK TRANSPORTING DUST-LADEN GASES

DESCRIPTION

1. Technical Field

The invention is directed to means for reducing dust dropout and for minimizing pressure loss in horizontal flue runs of duct work when such duct work has been improperly sized for gas load conditions, or when severe boiler partload conditions are encountered.

2. Background of Prior Art

It is known to reduce flyash and dust deposits in horizontal runs of flue duct work by enlarging the fan blower systems, and to remove flyash accumulations in flues and breechings by the use of commercially available soot blowers which have nozzles directed to zones of dust and soot accumulations to re-suspend the accumulated materials.

Increasing the flow velocity by increasing fan capacity, or by installing soot blowers, add substantially to plant operational and maintenance cost and, of course, initial installation.

BRIEF SUMMARY OF INVENTION

It has been found that a cost-effective way to reduce gravitational dust dropout in horizontal flue runs is to mount baffles onto the roof to extend into the flowing gas stream perpendicular to the direction of gas flow. The baffles may be fixed or moveable, depending upon the needs of the installation as to be more fully discussed hereinafter. The use of such roof baffles eliminates the need for major flue rebuilding as existing internal truss work in such horizontal flue work can usually be used to support the baffles. Further, roof baffles deflect high velocity gas flow down towards the flue floor and thus are more effective than reducing the flues cross-sectional area.

Further, it has been found that roof baffles allow free gas circulation to substantially all surfaces within the flue, thus, "cold-spots", with their inherent thermal stresses, are avoided. Reduction of cold spots is of primary interest when the flue run is located upstream of a heat exchanger.

BRIEF DESCRIPTION OF DRAWINGS

The present invention will be more fully described in reference to the accompanying drawing wherein.

DETAILED DESCRIPTION OF INVENTION

Figure 1:
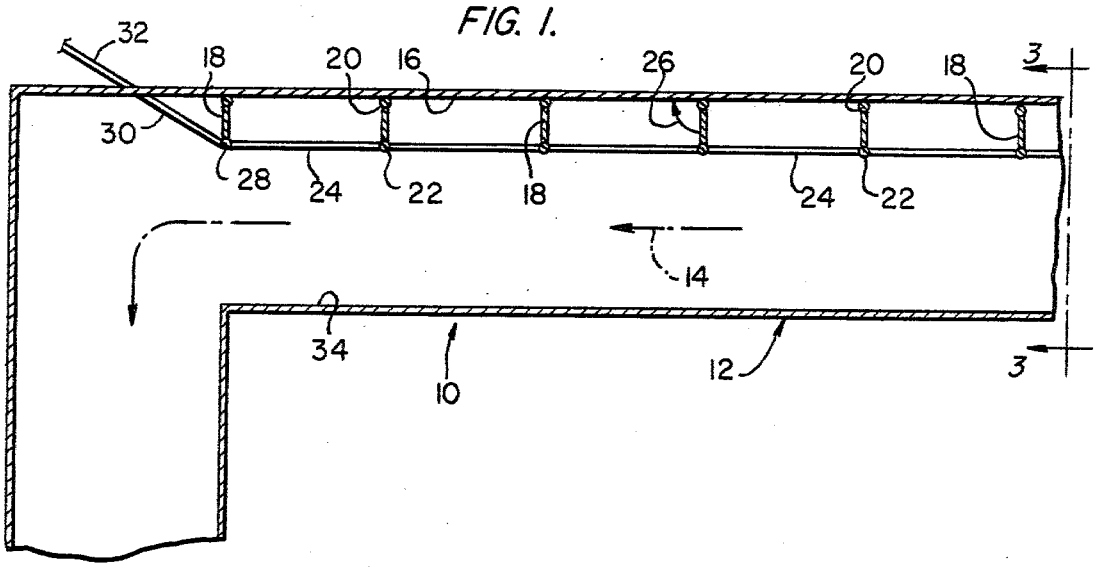
FIG. 1 is a diagrammatic cross-sectional view of the roof baffle installation wherein the baffles are mounted for particulate movement, thus being particularly advantageous on installations where there is substantial differences between full and part load flow conditions.

Referring to the drawing, 10 generally designates duct work for conveying gases from, for example, an industrial boiler to an electrostatic precipitator, economizer, preheater, etc., which duct work has a horizontal run 12. In the illustrated embodiment the arrow 14 designates the direction of flow of the gas in the duct work.

Articulately supported from the roof 16 of the horizontal run 12 of the duct are a plurality of spaced baffles designated 18.

Figure 3:
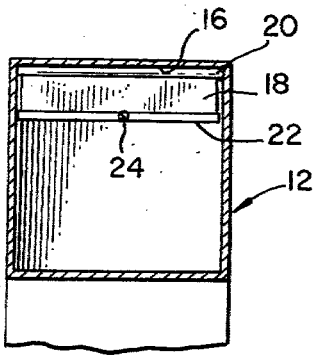
FIG. 3 is a section on line 3—3 of FIG. 1.
Figure 4:
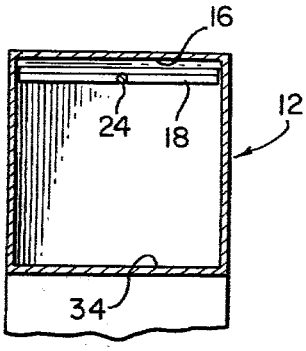
FIG. 4 is a section on line 4—4 of FIG. 2.
Figure 2:
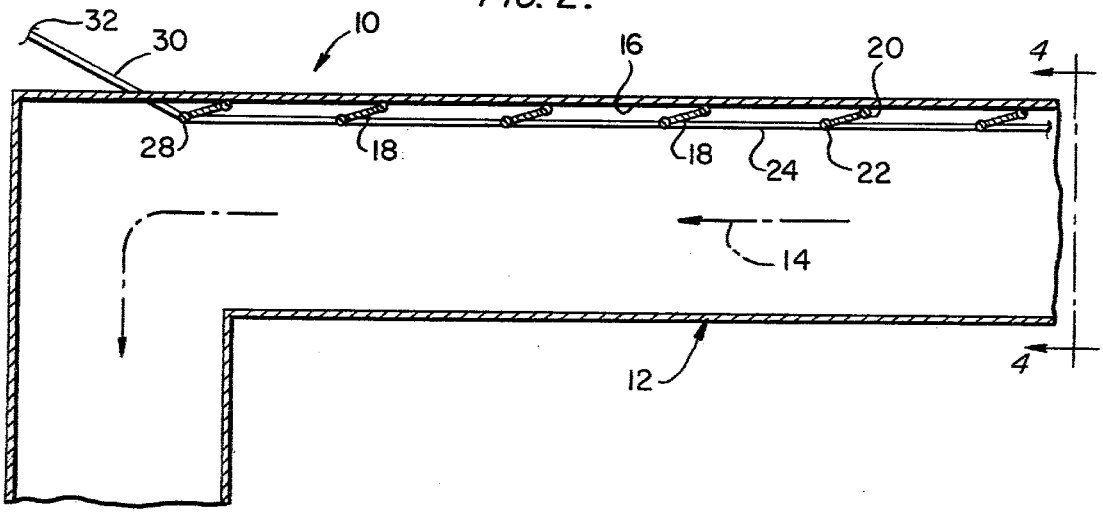
FIG. 2 is a view like FIG. 1 with the baffles raised to prevent high pressure drop during full load gas conditions.

In the preferred form of the invention the baffles 18 are mounted for pivotal movement transverse to the direction of gas flow by a suitable hinge linkage means 20. The lower ends of the baffles are similarly hinged as at 22 to a plurality of tierods or links 24 so that movement of any one baffle 18 will cause each of the plurality of baffles to move in an identical pivotal path such as indicated by directional arrow 26. The first or the last baffle in the series is connected adjacent its lower end 28 by an adjusting rod or link member 30 which preferably has its extended end 32 positioned outside of the duct roof 16 so that the position of the baffles relative to the vertical can be set by personnel without entering the duckwork. In FIG. 1 and FIG. 3, the baffles 18 are illustrated in the vertical position whereas in FIGS. 2 and 4 the baffles are illustrated in a folded condition in close proximity to the duct ceiling 16. In the FIGS. 1 and 3 illustration the boilers connected to the ducts would be operating under part-load conditions, and in FIGS. 2 and 4 at full-load conditions. Thus, at full load the roof baffles are raised to prevent high pressure drop due to high velocity flow of ducted gas.

In the illustrated form of the invention the roof baffles are moveable to correct velocity flow through the ductwork 10 under varying boiler loads. However, it will be recognized by those skilled in the art that in some installation the cross-sectional area of the duct was too great even for substantially constant load boiler conditions, and resulted in substantial deposits of dust on the inner lower surface 34 of the duct. Such conditions are remedied by permanent mounting of appropriately sized roof baffles in the horizontal runs of the duct.

Roof baffles should be designed to produced gas flow velocities from about 35 fps to about 45 fps on the flue floor 34 at the boiler's most extreme part-load flow rate. Laboratory tests and field experience have shown that a gas velocity of about 35 fps is adequate for dust removal if the flue floor is smooth and the bulk density of the flyash or other suspended material is less than 60 lbs/ft$^3$. When an excessive number of expansion joints, flanges, and internal flue support trusses are present in the flue, and when the bulk density of the ash is over 60 lbs/ft$^3$, then flue velocity must be at least about 45 fps for effective dust removal.

The flow properties of roof baffles were investigated and the data presented on Table I has been generalized so that it can be used as preliminary design guidelines. The roof baffles 18 were uniformly spaced 0.40 flue hydraulic diameters apart. As used herein, "flue hydraulic diameter" is four times the cross-sectional area of the flue divided by the wetted perimeter of the flue. At this distance, the gas flow remained steady, with no sign of flow re-expansion between the baffles. One size baffle blocked 22% of the cross-sectional area, and produced 145% to 158% of the flue's average velocity ($V_{avg}$) at the floor.

A larger size baffle blocked 30% of the cross-sectional area, and produced 1.50 $V_{avg}$ to 1.64 $V_{avg}$ at the flue floor. Equations for calculating the change in system pressure loss are also given on Table I. It will be noted that these equations predict additional system pressure losses at 70° F. and one atmosphere pressure, and they are only valid for the roof baffle spacings and percent obstructions listed.

For an example of how Table I can be used, consider the following horizontal flue run:

. $V_{avg}=50$ fps at full load
. $V_{avg}=25$ fps at minimum part load
. Flue Temperature—280° F. at both load points
. H=20 ft., W=40 ft., L=100 ft.
. Smooth flue floor
. Flyash bulk density less than 60 lb/ft$^3$ If 4.4 foot high roof baffles are spaced every 10.7 ft., then gas velocity near the flue floor at part load will range between 36.3 fps and 39.5 fps, which in this case is adequate for effective dust removal. Additional system pressure loss will be 0.17"$H_2O$ at part load, and 0.43"$H_2O$ at full load operation, for a flue temperature of 280° F.

In general spacings between baffles of from about 0.15 to about 0.90 flue hydraulic diameters apart and sized to block from 5% to about 50% of the cross-sectional area of the duct to produce from about 110% to about 300% of the flue's average velocity at the floor of the duct should provide satisfactory design guidelines to carry out the concepts of the present invention.

TABLE I

ROOF BAFFLES (MODEL DATA)

| Roof Baffle Spacing (ft) | % Cross Sectional Flue Obstruction Per Baffle | % of $V_{avg}$ at Flue Floor | Increase in Pressure Drop for air at 70° F. ("$H_2O$) |
|---|---|---|---|
| 0.40 HD | 22% | 145% to 158% | 0.44 $VH_{avg}$ (L/HD) |
| 0.40 HD | 30% | 150% to 164% | 0.63 $VH_{avg}$ (L/HD) |

I claim:

1. Apparatus for reducing gravitational dust dropout in horizontal run of flue gas conveying flues comprising:

a horizontally disposed gas conveying flue having roof, floor and side walls; and a plurality of vertically depending and longitudinally spaced baffles mounted to the inner surface of the roof of the flue;

wherein the spacings between baffles is from about 0.15 to about 0.90 flue hyraulic diameters, and sized to block from 5% to 50% of the cross-sectional area of the flue.

2. Apparatus for recuding gravitational dust dropout in horizontal run of flue gas conveying flues comprising:

a horizontally disposed gas conveying flue having roof, floor and side walls;

a plurality of vertically depending and longitudinally spaced baffles mounted to the inner surface of the roof of the flue;

characterized in that the said baffles are mounted for pivotal movement on axis transverse to the direction of flow of a gas in the flue;

wherein the spacings between baffles is from about 0.15 to about 0.90 flue hydraulic diameters, and sized to block from 5% to about 50% of the cross-sectional area of the flue.

3. Apparatus for reducing gravitational dust dropout in horizontal run of flue gas conveying flues comprising:

a horizontally disposed gas conveying flue having roof, floor and side walls;

a plurality of vertically depending and longitudinally spaced baffles mounted to the inner surface of the roof of the flue;

that the said baffles are mounted for pivotal movement on axis transverse to the direction of flow of a gas in the flue;

wherein means are provided to move the baffles about said transverse axis;

further characterized in that said means for moving said baffles is provided with an operating control mounted outside of the flue; and wherein the spacings between baffles is from about 0.15 to about 0.90 flue hydraulic diameters, and sized to block from 5% to about 50% of the cross-sectional area of the flue.

4. Apparatus for reducing gravitational dust dropout in horizontal run of flue gas conveying flues comprising:

a horizontally disposed gas conveying flue having roof, floor and side walls;

a plurality of vertically depending and longitudinally spaced baffles mounted to the inner surface of the roof of the flue;

characterized in that the said baffles are mounted for pivotal movement on axis transverse to the direction of flow of a gas in the flue;

wherein means are provided to move the baffles about said transverse axis;

further characterized in that said means for moving said baffles is provided with an operating control mounted outside of the flue; and wherein the spacings between baffles is from about 0.15 to about 0.90 flue hydraulic diameters, and sized to block from 5% to about 50% of the cross-sectional area of the flue.

* * * * *